US005721205A

United States Patent [19]

Barnabas et al.

[11] Patent Number: 5,721,205

[45] Date of Patent: Feb. 24, 1998

[54] CELLULASE FABRIC-CONDITIONING COMPOSITIONS

[75] Inventors: Mary Vijayarani Barnabas, West Chester; Kimberley Suzanne Severin; Scott William Waite, both of Cincinnati, all of Ohio

[73] Assignee: The Procter & Gamble Company, Cincinnati, Ohio

[21] Appl. No.: 815,232

[22] Filed: Mar. 12, 1997

Related U.S. Application Data

[63] Continuation of Ser. No. 692,544, Aug. 5, 1996, abandoned, which is a continuation of Ser. No. 566,370, Dec. 1, 1995, abandoned, which is a continuation of Ser. No. 385,243, Feb. 7, 1995, abandoned, which is a continuation-in-part of Ser. No. 236,914, Apr. 29, 1994, abandoned.

[51] Int. Cl.[6] ..... D06M 16/00; D06M 13/46

[52] U.S. Cl. ..... 510/522; 510/521; 510/527; 510/530; 435/263

[58] Field of Search ..... 510/522, 530, 510/521, 527, 263

[56] References Cited

U.S. PATENT DOCUMENTS

| | | | |
|---|---|---|---|
| 3,861,870 | 1/1975 | Edwards et al. | 8/115.6 |
| 3,886,075 | 5/1975 | Bernardino | 252/8.75 |
| 3,954,630 | 5/1976 | Ramachandran | 252/8.6 |
| 3,974,076 | 8/1976 | Wiersema et al. | 252/8.8 |
| 4,137,180 | 1/1979 | Naik et al. | 252/8.8 |
| 4,233,164 | 11/1980 | Davis | 252/8.8 |
| 4,237,016 | 12/1980 | Rudkin et al. | 252/8.8 |
| 4,308,151 | 12/1981 | Cambre | 252/8.8 |
| 4,401,578 | 8/1983 | Verbruggen | 252/8.8 |
| 4,429,859 | 2/1984 | Steiner et al. | 252/8.8 |
| 4,435,307 | 3/1984 | Barbesgaard et al. | 252/174.12 |
| 4,439,335 | 3/1984 | Burns | 252/8.75 |
| 4,479,881 | 10/1984 | Tai | 252/8.8 |
| 4,648,979 | 3/1987 | Parslow et al. | 252/8.8 |
| 4,661,269 | 4/1987 | Trinh et al. | 252/8.8 |
| 4,661,289 | 4/1987 | Parslow et al. | 252/547 |
| 4,738,682 | 4/1988 | Boegh et al. | 8/401 |
| 4,767,547 | 8/1988 | Straathof et al. | 252/8.8 |
| 5,009,800 | 4/1991 | Foster | 252/8.9 |
| 5,093,014 | 3/1992 | Neillie | 252/8.8 |
| 5,120,463 | 6/1992 | Bjork et al. | 252/174.12 |
| 5,156,761 | 10/1992 | Aaslyng et al. | 252/174.12 |
| 5,213,581 | 5/1993 | Olson et al. | 8/401 |
| 5,232,851 | 8/1993 | Cox et al. | 435/263 |
| 5,246,853 | 9/1993 | Clarkson et al. | 435/263 |
| 5,599,786 | 2/1997 | Siklosi et al. | 510/522 |
| 5,616,553 | 4/1997 | Hartman et al. | 510/522 |

FOREIGN PATENT DOCUMENTS

| | | |
|---|---|---|
| 173397 | 3/1986 | European Pat. Off. . |
| 269168 | 6/1988 | European Pat. Off. . |
| 293055 | 11/1988 | European Pat. Off. . |
| 350098 | 1/1990 | European Pat. Off. . |
| 409504 | 1/1991 | European Pat. Off. . |
| 486113 | 5/1992 | European Pat. Off. . |
| 239910 | 10/1992 | European Pat. Off. . |
| 507478 | 10/1992 | European Pat. Off. . |
| 2108069 | 5/1972 | France . |
| 5 8036217 | 3/1983 | Japan . |
| 5 8054082 | 3/1983 | Japan . |
| 63-6098 | 1/1988 | Japan . |
| 1040681 | 2/1989 | Japan . |
| 1368599 | 10/1974 | United Kingdom . |
| 2075028 | 11/1981 | United Kingdom . |
| 2094826 | 9/1982 | United Kingdom . |
| 2095275 | 9/1982 | United Kingdom . |
| 2258655 | 2/1993 | United Kingdom . |
| WO91/13136 | 9/1991 | WIPO . |
| WO91/17243 | 11/1991 | WIPO . |
| WO92/06210 | 4/1992 | WIPO . |
| WO93/12224 | 6/1993 | WIPO . |
| WO93/16158 | 8/1993 | WIPO . |
| WO95/05442 | 2/1995 | WIPO . |

*Primary Examiner*—Anthony Green
*Attorney, Agent, or Firm*—K. W. Zerby; J. J. Yetter; J. C. Rasser

[57] ABSTRACT

Fabric softening compositions comprising fabric softening active(s), cellulase and an antioxidant effective amount of free radical scavenging antioxidant material and/or chelant.

14 Claims, No Drawings

CELLULASE FABRIC-CONDITIONING COMPOSITIONS

This is a continuation of application Ser. No. 08/692,544, filed Aug. 5, 1996; which is a continuation of application Ser. No. 08/566,370, filed Dec. 1, 1995; which is a continuation of application Ser. No. 08/385,243, filed Feb. 7, 1995; which is a continuation-in-part of application Ser. No. 08/236,914, filed Apr. 29, 1994, now all abandoned.

TECHNICAL FIELD

The present invention relates to fabric-conditioning compositions to be used in the rinse cycle of laundry washing processes, in order to impart softness as well as fabric appearance benefits to fabrics, said compositions comprising fabric softening active(s), cellulase, and antioxidant and/or chelant.

BACKGROUND OF THE INVENTION

Fabric conditioning compositions, in particular fabric softening compositions to be used in the rinse cycle of laundry washing processes, are well known. Typically, such compositions contain a water-insoluble quaternary-ammonium fabric softening agent, the most commonly used having been di-long alkyl chain ammonium chloride.

The anti-harshening effect of cellulase on fabrics is known from e.g. FR 2 481 712 or GB-A-1 368 599, as well as their fabric care benefits, disclosed in e.g. EPA 269 168, all incorporated herein by reference in their entirety. Cellulases have been mainly described however for use in detergent compositions to be used in the main wash cycle of laundry processes, and have found some commercial application in this context.

In spite of such teachings, the use of cellulases in rinse added fabric softener compositions has apparently not been commercially pursued so far. The reason may be that one of the potential issues to be resolved is to provide acceptable stability of the cellulase in such compositions upon storage. Another reason may be potential issues to be resolved around the effectiveness of cellulase use in the rinse cycle following a normal detergent wash cycle. Such conditions are typically of shorter duration and lower temperatures than used in the wash cycle, and there are concerns around potential for fabric damage if too high activity cellulase conditions are met by the rinse cycle use conditions and/or by carry over of cellulase activity from use of cellulase-containing detergents in the wash cycle.

It has been discovered that rinse added fabric softener compositions can be formulated to contain cellulase to provide cellulase activity during normal use conditions to be within certain limits so as to provide fabric softening benefits with an acceptable impact on fabric wear. The present invention provides cellulase-containing fabric softener compositions in which the cellulase is further stabilized for storage by the addition of antioxidants and/or chelants. This allows for formulation of fabric softening compositions over the entire typical pH range of fabric softening agents, including pH of 5 to 7 for traditional fabric softening actives, while achieving both effectiveness and fabric safety benefits following prolonged storage.

SUMMARY OF THE INVENTION

The present invention relates to fabric conditioning compositions comprising one or more cationic and/or nonionic fabric softening agents, cellulase, and an antioxidant effective amount of free radical scavenging antioxidant material and/or chelant. Preferred compositions having cellulase present at a level such that the compositions deliver an effective amount of cellulase below about 50 CEVU's per liter of rinse solution during normal washing rinse cycle use conditions.

DETAILED DESCRIPTION OF THE INVENTION

The Cellulase

The cellulase usable in the compositions herein can be any bacterial or fungal cellulase. Suitable cellulases are disclosed, for example, in GB-A-2 075 028, GB-A-2 095 275 and DE-OS-24 47 832, all incorporated herein by reference in their entirety.

Examples of such cellulases are cellulase produced by a strain of *Humicola insolens* (*Humicola grisea* var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labelled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The cellulases herein should be used in the fabric-conditioning compositions of the present invention at a level equivalent to an activity from about 0.05 (preferably about 0.1) to about 125 CEVU/gram of composition [CEVU= Cellulase (equivalent) Viscosity Unit, as described, for example, in WO 91/13136, incorporated herein by reference in its entirety], and most preferably about 5 to about 100. Such levels of cellulase are selected to provide the herein preferred cellulase activity at a level such that the compositions deliver a fabric softening effective amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 1 CEVU's per liter rinse solution to about 50 CEVU's per liter rinse solution, more perferably from about 2 CEVU's per liter to about 30 CEVU's per liter, even more preferably from about 5 CEVU's per liter to about 25 CEVU's per liter, and most perferably from about 10 CEVU's per liter to about 20 CEVU's per liter.

The Cationic or Nonionic Fabric Softening Agents

The preferred fabric softening agents to be used in the present invention compositions are quaternary ammonium compounds or amine precursors herein having the formula (I) or (II), below:

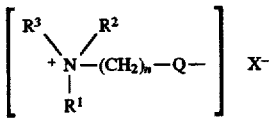

(I)

or

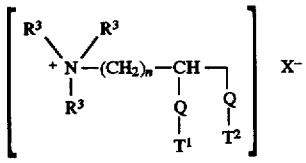

(II)

Q is —O—C(O)— or —C(O)—O— or —O—C(O)—O— or —$NR^4$—C(O)— or —C(O)—$NR^4$—, $R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1, T^2, T^3, T^4, T^5$ are (the same or different) $C_{11}$–$C_{22}$ alkyl or alkenyl;

n and m are integers from 1 to 4; and $X^-$ is a softener-compatible anion.

The alkyl, or alkenyl, chain $T^1, T^2, T^3, T^4, T^5$ must contain at least 11 carbon atoms, preferably at least 16 carbon atoms. The chain may be straight or material. The compounds wherein $T^1$, $T^2$, $T^3$, $T^4$, $T^5$ represents the mixture of long branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred. Specific examples of quaternary ammonium compounds suitable for use in the aqueous fabric softening compositions herein include:

1) N,N-di(tallowyl-oxy-ethyl)-N,N-dimethylammonium chloride;
2) N,N-di(tallowyl-oxy-ethyl)-N-methyl, N-(2-hydroxyethyl);
3) N,N-di(2-tallowyloxy-2-oxo-ethyl)-N,N-dimethylammonium chloride;
4) N,N-di(2-tallowyloxyethylcarbonyloxyethyl)-N,N-dimethylammonium chloride;
5) N-(2-tallowoyloxy-2-ethyl)-N-(2-tallowyloxy-2-oxo-ethyl)-N,N-dimethylammonium chloride;
6) N,N,N-tri(tallowyl-oxy-ethyl)-N-methylammonium chloride;
7) N-(2-tallowyloxy-2-oxoethyl)-N-(tallowyl-N,N-dimethyl-ammonium chloride; and
8) 1,2-ditallowyl oxy-3-trimethylammoniopropane chloride;

and mixtures of any of the above materials.

Of these, compounds 1–7 are examples of compounds of Formula (I); compound 8 is a compound of Formula (II).

Particularly preferred is N,N-di(tallowoyl-oxy-ethyl)-N, N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For the preceeding fabric softening agents, the pH of the compositions herein is an essential parameter of the present invention. Indeed, it influences the stability of the quaternary ammonium or amine precursors compounds, and of the cellulase, especially in prolonged storage conditions.

The pH, as defined in the present context, is measured in the neat compositions, in the continuous phase after separation of the dispersed phase by ultra centrifugation, at 20° C. For optimum hydrolytic stability of these compositions, the neat pH, measured in the above-mentioned conditions, must be in the range of from about 2.0 to about 4.5, preferably about 2.0 to about 3.5. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the present invention compositions are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weigt ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional fabric softening agents useful herein are described in U.S. Pat. No. 4,661,269, issued Apr. 28, 1987, in the names of Toan Trinh, Errol H. Wahl, Donald M. Swartley, and Ronald L. Hemingway; U.S. Pat. No. 4,439,335, Burns, issued Mar. 27, 1984; and in U.S. Pat. Nos.: 3,861,870, Edwards and Diehl; 4,308,151, Cambre; 3,886,075, Bernardino; 4,233,164, Davis; 4,401,578, Verbruggen; 3,974,076, Wiersema and Rieke; and 4,237,016, Rudkin, Clint, and Young, all of said patents being incorporated herein by reference.

For example, suitable fabric softener agents useful herein may comprise one, two, or all three of the following fabric softening agents:

(a) the reaction product of higher fatty acids with a polyamine selected from the group consisting of hydroxyalkylalkylenediamines and dialkylenetriamines and mixtures thereof (preferably from about 10% to about 80%); and/or (b) cationic nitrogenous salts containing only one long chain acyclic aliphatic $C_{15}$–$C_{22}$ hydrocarbon group (preferably from about 3% to about 40%); and/or (c) cationic nitrogenous salts having two or more long chain acyclic aliphatic $C_{15}$–$C_{22}$ hydrocarbon groups or one said group and an arylalkyl group (preferably from about 10% to about 80%);

with said (a), (b) and (c) preferred percentages being by weight of the fabric softening agent component of the present invention compositions.

Following are the general descriptions of the preceeding (a), (b), and (c) softener ingredients (including certain specific examples which illustrate, but do not limit the present invention).

Component (a): Softening agents (actives) of the present invention may be the reaction products of higher fatty acids with a polyamine selected from the group consisting of hydroxyalkylalkylenediamines and dialkylenetriamines and mixtures thereof. These reaction products are mixtures of several compounds in view of the multi-functional structure of the polyamines.

The preferred Component (a) is a nitrogenous compound selected from the group consisting of the reaction product mixtures or some selected components of the mixtures. More specifically, the preferred Component (a) is compounds selected from the group consisting of:

(i) the reaction product of higher fatty acids with hydroxy alkylalkylenediamines in a molecular ratio of about 2:1, said reaction product containing a composition having a compound of the formula:

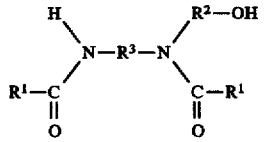

wherein $R^1$ is an acyclic aliphatic $C_{15}$–$C_{21}$ hydrocarbon group and $R^2$ and $R^3$ are divalent $C_1$–$C_3$ alkylene groups;

(ii) substituted imidazoline compounds having the formula:

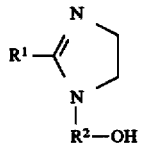

wherein $R^1$ and $R^2$ are defined as above;

(iii) substituted imidazoline compounds having the formula:

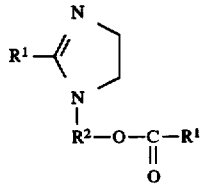

wherein $R^1$ and $R^2$ are defined as above;

(iv) the reaction product of higher fatty acids with di alkylenetriamines in a molecular ratio of about 2:1, said reaction product containing a composition having a compound of the formula:

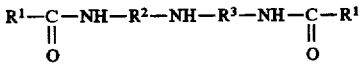

wherein $R^1$, $R^2$ and $R^3$ are defined as above; and (v) substituted imidazoline compounds having the formula:

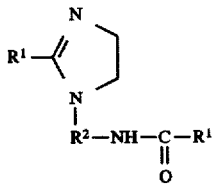

wherein $R^1$ and $R^2$ are defined as above; and (vi) mixtures thereof.

Component (a)(i) is commercially available as Mazamide® 6, sold by Mazer Chemicals, or Ceranine® HC, sold by Sandoz Colors & Chemicals; here the higher fatty acids are hydrogenated tallow fatty acids and the hydroxyalkylalkylenediamine is N-2-hydroxyethylethylenediamine, and $R^1$ is an aliphatic $C_{15}$–$C_{17}$ hydrocarbon group, and $R^2$ and $R^3$ are divalent ethylene groups.

An example of Component (a)(ii) is stearic hydroxyethyl imidazoline wherein $R^1$ is an aliphatic $C_{17}$ hydrocarbon group, $R^2$ is a divalent ethylene group; this chemical is sold under the trade names of Alkazine® ST by Alkaril Chemicals, Inc., or Schercozoline® S by Scher Chemicals, Inc. An example of Component (a)(iv) is N,N"-ditallowalkoyldiethylenetriamine where $R^1$ is an aliphatic C15-C17 hydrocarbon group and $R^2$ and $R^3$ are divalent ethylene groups.

An example of Component (a)(v) is 1-tallowamidoethyl-2-tallowimidazoline wherein $R^1$ is an aliphatic $C_{15}$–$C_{17}$ hydrocarbon group and $R^2$ is a divalent ethylene group.

The Components (a)(iii) and (a)(v) can also be first dispersed in a Bronsted acid dispersing aid having a pKa value of not greater than about 4; provided that the pH of the final composition is not greater than about 5. Some preferred dispersing aids are hydrochloric acid, phosphoric acid, or methylsulfonic acid.

Both N,N"-ditallowalkoyldiethylenetriamine and 1-tallow(amido ethyl)-2-tallowimidazoline are reaction products of tallow fatty acids and diethylenetriamine, and are precursors of the cationic fabric softening agent methyl-1-tallowamidoethyl-2-tallowimidazolinium methylsulfate (see "Cationic Surface Active Agents as Fabric Softeners," R. R. Egan, Journal of the American Oil Chemicals' Society, January 1978, pages 118–121). N,N"-ditallow alkoyldiethylenetriamine and 1-tallowamidoethyl-2-tallowimidazoline can be obtained from Witco Chemical Company as experimental chemicals. Methyl-1-tallowamidoethyl-2-tallowimidazolinium methylsulfate is sold by Witco Chemical Company under the tradename Varisoft® 475.

Component (b): The preferred Component (b) is a cationic nitrogenous salt containing one long chain acyclic aliphatic $C_{15}$–$C_{22}$ hydrocarbon group selected from the group consisting of:

(i) acyclic quaternary ammonium salts having the formula:

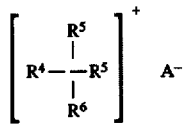

wherein $R^4$ is an acyclic aliphatic $C_{15}$–$C_{22}$ hydrocarbon group, $R^5$ and $R^6$ are $C_1$–$C_4$ saturated alkyl or hydroxy alkyl groups, and $A^-$ is an anion;

(ii) substituted imidazolinium salts having the formula:

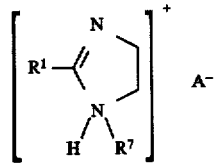

wherein $R^1$ is an acyclic aliphatic $C_{15}$–$C_{21}$ hydrocarbon group, $R^7$ is a hydrogen or a $C_1$–$C_4$ saturated alkyl or hydroxyalkyl group, and $A^-$ is an anion;

(iii) substituted imidazolinium salts having the formula:

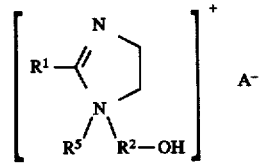

wherein $R^2$ is a divalent $C_1$–$C_3$ alkylene group and $R^1$, $R^5$ and $A^-$ are as defined above;

(iv) alkylpyridinium salts having the formula:

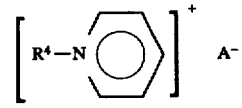

wherein $R^4$ is an acyclic aliphatic $C_{16}$–$C_{22}$ hydrocarbon group and $A^-$ is an anion; and (v) alkanamide alkylene pyridinium salts having the formula:

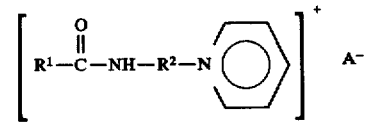

wherein $R^1$ is an acyclic aliphatic $C_{15}$–$C_{21}$ hydrocarbon group, $R^2$ is a divalent $C_1$–$C_3$ alkylene group, and $A^-$ is an ion group;

(vi) monoester quaternary ammonium compounds having the formula:

$$[(R)_3—N^+—(CH_2)_n—Y—R^2]A^-$$

wherein each Y=—O—(O)C—, or —C(O)—O—;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl or mixtures thereof, $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, $A^-$, can be any softener-compatible anion, for example, chloride, bromide, methylsulfate, formate, sulfate, nitrate and the like; and (vii) mixtures thereof.

Examples of Component (b)(i) are the monoalkyltrimethylammonium salts such as monotallowtrimethylammonium chloride, monohydrogenated tallow) trimethylammonium chloride, palmityltrimethylammonium chloride and soyatrimethylammonium chloride, sold by Sherex Chemical Company under the trade name Adogen® 471, Adogen® 441, Adogen® 444, and Adogen® 415, respectively. In these salts, $R^4$ is an acyclic aliphatic $C_{16}$–$C_{18}$ hydrocarbon group, and $R^5$ and $R^6$ are methyl groups. Mono(hydrogenated tallow)trimethylammonium chloride and monotallowtrimethylammonium chloride are preferred.

Other examples of Component (b)(i) are behenyltrimethylammonium chloride wherein $R^4$ is a $C_{22}$ hydrocarbon group and sold under the trade name Kemamine® Q2803-C by Humko Chemical Division of Witco Chemical Corporation; soyadimethylethylammonium ethylsulfate wherein $R^4$ is a $C_{16}$–$C_{18}$ hydrocarbon group, $R^5$ is a methyl group, $R^6$ is an ethyl group, and $A^-$ is an ethylsulfate anion, sold under the trade name Jordaquat® 1033 by Jordan Chemical Company; and methyl-bis(2-hydroxyethyl)-octadecylammonium chloride wherein $R^4$ is a $C_{18}$ hydrocarbon group, $R^5$ is a 2-hydroxyethyl group and $R^6$ is a methyl group and available under the trade name Ethoquad® 18/12 from Armak Company.

An example of Component (b)(iii) is 1-ethyl-1-(2-hydroxy ethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion. It is available from Mona Industries, Inc., under the trade name Monaquat® ISIES.

An example of Component (b)(vi) is mono (tallowoyloxyethyl) hydroxyethyldimethylammonium chloride, i.e., monoester of tallow fatty acid with di(hydroxyethyl)dimethylammonium chloride, a by-product in the process of making diester of tallow fatty acid with di(hydroxyethyl)dimethylammonium chloride, i.e., di(tallowoyloxyethyl)dimethylammonium chloride, a (c)(vii) component (vide infra).

Component (c): Preferred cationic nitrogenous salts having two or more long chain acyclic aliphatic $C_{15}$–$C_{22}$ hydrocarbon groups or one said group and an arylalkyl group which can be used either alone or as part of a mixture are selected from the group consisting of:

(i) acyclic quaternary ammonium salts having the formula:

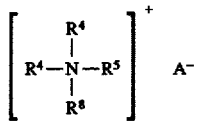

wherein $R^4$ is an acyclic aliphatic $C_{15}$–$C_{22}$ hydrocarbon group, $R^5$ is a $C_1$–$C_4$ saturated alkyl or hydroxyalkyl group, $R^8$ is selected from the group consisting of $R^4$ and $R^5$ groups, and $A^-$ is an anion defined as above;

(ii) diamido quaternary ammonium salts having the formula:

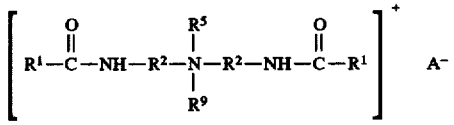

wherein $R^1$ is an acyclic aliphatic $C_{15}$–$C_{21}$ hydrocarbon group, $R^2$ is a divalent alkylene group having 1 to 3 carbon atoms, $R^5$ and $R^9$ are $C_1$–$C_4$ saturated alkyl or hydroxyalkyl groups, and $A^-$ is an anion;

(iii) diamino alkoxylated quaternary ammonium salts having the formula:

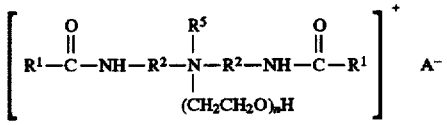

wherein n is equal to 1 to about 5, and $R^1$, $R^2$, $R^5$ and $A^-$ are as defined above;

(iv) quaternary ammonium compounds having the formula:

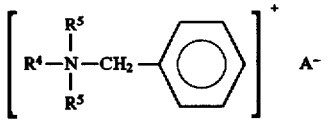

wherein $R^4$ is an acyclic aliphatic $C_{15}$–$C_{22}$ hydrocarbon group, $R^5$ is a $C_1$–$C_4$ saturated alkyl or hydroxyalkyl group, $A^-$ is an anion;

(v) substituted imidazolinium salts having the formula:

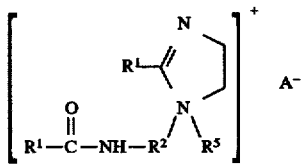

wherein $R^1$ is an acyclic aliphatic $C_{15}$–$C_{21}$ hydrocarbon group, $R^2$ is a divalent alkylene group having 1 to 3 carbon atoms, and $R^5$ and $A^-$ are as defined above; and (vi) substituted imidazolinium salts having the formula:

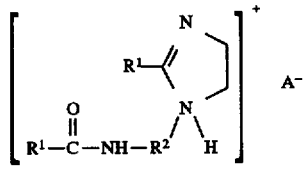

wherein $R^1$, $R^2$ and $A^-$ are as defined above;

(vii) diester quaternary ammonium (DEQA) compounds having the formula:

$$(R)_{4-m}—N^+—[(CH_2)_n—Y—R^2]_m\ A^-$$

wherein each Y=—O—(O)C—, or —C(O)—O—;

m=2 or 3;

each n=1 to 4;

each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof;

each $R^2$ is a long chain $C_{10}$–$C_{22}$ hydrocarbyl, or substituted hydrocarbyl substituent, preferably $C_{15}$–$C_{19}$ alkyl and/or alkenyl, most preferably $C_{15}$–$C_{18}$ straight chain alkyl and/or alkenyl; and the counterion, $A^-$, can be any softener-compatible anion, for example, chloride, bromide, methylsulfate, formate, sulfate, nitrate and the like; and (viii) mixtures thereof.

Examples of Component (c)(i) are the well-known dialkyldimethylammonium salts such as ditallowdimethylammonium chloride, ditallowdimethylammonium methylsulfate, di(hydrogenated tallow)dimethylammonium chloride, distearyldimethylammonium chloride, dibehenyldimethylammonium chloride. Di(hydrogenated tallow) dimethylammonium chloride and ditallowdimethylammonium chloride are preferred. Examples of commercially available dialkyldimethylammonium salts usable in the present invention are di(hydrogenated tallow)dimethylammonium chloride (trade name Adogen® 442), ditallowdimethylammonium chloride (trade name Adogen® 470), distearyl dimethylammonium chloride (trade name Arosurf® TA-100), all available from Witco Chemical Company. Dibehenyldimethylammonium chloride wherein $R^4$ is an acyclic aliphatic $C_{22}$ hydrocarbon group is sold under the trade name Kemamine Q-2802C by Humko Chemical Division of Witco Chemical Corporation.

Examples of Component (c)(ii) are methylbis (tallowamidoethyl)(2-hydroxyethyl)ammonium methylsulfate and methylbis(hydrogenated tallowamidoethyl)(2-hydroxyethyl)ammonium methylsulfate wherein $R^1$ is an acyclic aliphatic $C_{15}$–$C_{17}$ hydrocarbon group, $R^2$ is an ethylene group, $R^5$ is a methyl group, $R^9$ is a hydroxyalkyl group and $A^-$ is a methylsulfate anion; these materials are available from Witco Chemical Company under the trade names Varisoft® 222 and Varisoft® 110, respectively.

An example of Component (c)(iv) is dimethylstearylbenzylammonium chloride wherein $R^4$ is an acyclic aliphatic $C_{18}$ hydrocarbon group, $R^5$ is a methyl group and $A^-$ is a chloride anion, and is sold under the trade names Varisoft® SDC by Witco Chemical Company and Ammonyx® 490 by Onyx Chemical Company.

Examples of Component (c)(v) are 1-methyl-1-tallowamidoethyl-2-tallowimidazolinium methylsulfate and 1-methyl-1-(hydrogenated tallowamidoethyl)-2-(hydrogenated tallow)imidazolinium methylsulfate wherein $R^1$ is an acyclic aliphatic $C_{15}$–$C_{17}$ hydrocarbon group, $R^2$ is an ethylene group, $R^5$ is a methyl group and $A^-$ is a chloride anion; they are sold under the trade names Varisoft® 475 and VarisoftR 445, respectively, by Witco Chemical Company.

It will be understood that for (c)(vii) above substituents R and $R^2$ can optionally be substituted with various groups such as alkoxyl or hydroxyl groups, and/or can be saturated, unsaturated, straight, and/or branched so long as the $R^2$ groups maintain their basically hydrophobic character. Preferred softening compounds are biodegradable such as those in Component (c)(vii). These preferred compounds can be considered to be diester variations of ditallow dimethyl ammonium chloride (DTDMAC), which is a widely used fabric softener.

The following are non-limiting examples of (c)(vii) (wherein all long-chain alkyl substituents are straight-chain):

$[CH_3]_2{}^+N[CH_2CH_2OC(O)R^2]\ Cl^-$ $[HOCH(CH_3)CH_2][CH_3]^+N[CH_2CH_2OC(O)C_{15}H_{31}]_2\ Br^-$ $[C_2H_5]_2{}^+N[CH_2CH_2OC(O)C_{17}H_{35}]_2\ Cl^-$ $[CH_3][C_2H_5]^+N[CH_2CH_2OC(O)C_{13}H_{27}]_2\ I^-$ $[C_3H_7][C_2H_5]^+N[CH_2CH_2OC(O)C_{15}H_{31}]_2\ {}^-SO_4CH_3$ $[CH_3]_2{}^+N-CH_2CH_2OC(O)C_{15}H_{31}\ Cl^-$ $|$ $CH_2CH_2OC(O)C_{17}H_{35}$ $[CH_2CH_2OH][CH_3]^+N[CH_2CH_2OC(O)R^2]_2\ Cl^-$ where —C(O)$R^2$ is derived from soft tallow and/or hardened tallow fatty acids. Especially preferred is diester of soft and/or hardened tallow fatty acids with di(hydroxyethyl) dimethylammonium chloride, also called di(tallowoyloxyethyl)dimethylammonium chloride.

Since the foregoing compounds (diesters) are somewhat labile to hydrolysis, they should be handled rather carefully when used to formulate the compositions herein. For example, stable liquid compositions herein are formulated at a pH in the range of about 2 to about 5, preferably from about 2 to about 4.5, more preferably from about 2 to about 4. The pH can be adjusted by the addition of a Bronsted acid. Ranges of pH for making stable softener compositions containing diester quaternary ammonium fabric softening compounds are disclosed in U.S. Pat. No. 4,767,547, Straathof and Konig, issued Aug. 30, 1988, and is incorporated herein by reference.

The diester quaternary ammonium fabric softening compound (DEQA) of (c)(vii) can also have the general formula:

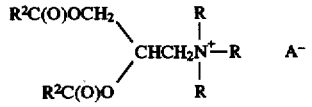

wherein each R, $R^2$, and $A^-$ have the same meanings as before. Such compounds include those having the formula:

$[CH_3]_3{}^+N[CH_2CH(CH_2OC(O)R^2)OC(O)R^2]Cl^-$ where —OC(O)$R^2$ is derived from soft tallow and/or hardened tallow fatty acids.

Preferably each R is a methyl or ethyl group and preferably each $R^2$ is in the range of $C_{15}$ to $C_{19}$. Degrees of branching, substitution and/or non-saturation can be present in the alkyl chains. The anion $A^-$ in the molecule is preferably the anion of a strong acid and can be, for example, chloride, bromide, sulphate, and methyl sulphate; the anion can carry a double charge in which case $A^-$ represents half a group. These compounds, in general, are more difficult to formulate as stable concentrated liquid compositions.

These types of compounds and general methods of making them are disclosed in U.S. Pat. No. 4,137,180, Naik et at., issued Jan. 30, 1979, which is incorporated herein by reference.

A preferred composition contains Component (a) at a level of from about 10% to about 80%, Component (b) at a level of from about 3% to about 40%, and Component (c) at a level of from about 10% to about 80%, by weight of the fabric softening component of the present invention compositions. A more preferred composition contains Component (c) which is selected from the group consisting of: (i) di(hydrogenated tallow)dimethylammonium chloride; (v) methyl-1-tallowamidoethyl-2-tallowimidazolinium methylsulfate; (vii) diethanol ester dimethylammonium chloride; and mixtures thereof.

An even more preferred composition contains Component (a): the reaction product of about 2 moles of hydrogenated tallow fatty acids with about 1 mole of N-2-hydroxyethylethylenediamine and is present at a level of from about 20% to about 70% by weight of the fabric softening component of the present invention compositions; Component (b): mono(hydrogenated tallow) trimethylammonium chloride present at a level of from about 3% to about 30% by weight of the fabric softening component of the present invention compositions; Component (c): selected from the group consisting of di(hydrogenated tallow)dimethylammonium chloride, ditallowdimethylammonium chloride, methyl-1-tallowamidoethyl-2-tallowimidazolinium methylsulfate, diethanol ester dimethylammonium chloride, and mixtures thereof, wherein Component (c) is present at a level of from about 20% to about 60% by weight of the fabric softening component of the present invention compositions; and wherein the weight ratio of said di(hydrogenated tallow) dimethylammonium chloride to said methyl-1-tallowamidoethyl-2-tallowimidazolinium methylsulfate is from about 2:1 to about 6:1.

The above individual components can also be used individually, especially those of I(c) (e.g., ditallowdimethylammonium chloride or diethanol ester dimethylammonium chloride).

In the cationic nitrogenous salts described hereinbefore, the anion $A^-$ provides charge neutrality. Most often, the anion used to provide charge neutrality in these salts is a halide, such as chloride or bromide. However, other anions can be used, such as methylsulfate, ethylsulfate, hydroxide, acetate, formate, citrate, sulfate, carbonate, and the like. Chloride and methylsulfate are preferred herein as anion $A^-$.

The amount of fabric softening agent (fabric softener) in liquid compositions of this invention is typically from about 2% to about 50%, preferably from about 4% to about 30%, by weight of the composition. The lower limits are amounts needed to contribute effective fabric softening performance when added to laundry rinse baths in the manner which is customary in home laundry practice. The higher limits are suitable for concentrated products which provide the consumer with more economical usage due to a reduction of packaging and distributing costs.

Free Radical Scavenging Antioxidant Materials and Chelants

The term "antioxidant effective amount", as used herein, means an amount of a free radical scavenging antioxidant material, chelant or mixtures thereof effective for increasing the storage stability of the cellulase in the present invention fabric-conditioning compositions. Levels of free radical scavenging antioxidant materials and chelants to be used in products are therefore easily determined, and are illustrated further hereinafter.

1. Free Radical Scavenging Antioxidant Materials

"Free radical scavenging antioxidant materials", as used herein, means those materials which act to prevent oxidation in products by functioning as free radical scavengers. Examples of such antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; and Irganox® antioxidants (supplied by Ciba-Geigy), such as Irganox® 1010 [tetrakis(methylene(3,5-di-tert-butyl-4-hydroxyhydrocinnamate))methane]; Irganox® 1035 [thiodiethylene bis(3,5-di-tert-butyl-4-hydroxyhydrocinnamate)]; Irganox® 1425 [calcium bis (monoethyl(3,5-di-tert-butyl-4-hydroxybenzyl) phosphonate)]; Irganox® 3114 [1,3,5-tris(3,5-di-tert-butyl-4-hydroxybenzyl)-s-triazine-2,4,6-(1H,3H-5H)trione]; Irganox® 3125 [3,5-di-tert-butyl-4-hydroxy-hydrocinnamic acid triester with 1,3,5-tris(2-hydroxyethyl)-S-triazine-2,4,6-(1H,3H,5H)-trione]; Irganox® 1098 [N,N'-hexamethylene bis(3,5-di-tert-butyl-4-hydroxyhydro-cinnamamide)]; and mixtures thereof.

Preferred are BHT, BHA, TBHQ, propyl gallate, and especially Irganox-3125, which has the chemical structure:

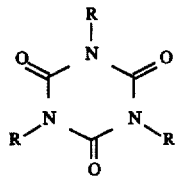

wherein R is

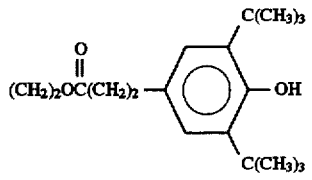

It is to be recognized that for purposes of the present invention, materials otherwise useful as antioxidants which do not act as free radical scavengers, such as those materials which function solely by chelating metals which can initiate oxidation reactions, are not "free radical scavenging antioxidant materials" herein but are chelants as described hereinafter. Free radical scavenging antioxidant materials are typically present in the compositions according to the present invention within the range of from about 10 ppm to about 0.5%, preferably from about 100 ppm to about 2,000 ppm, and most preferably from about 150 ppm to about 1000 ppm.

2. Chelants

The present invention compositions can also comprise chelants (which as used herein also includes materials effective not only for binding metals in solution but also those effective for precipitating metals from solution) alone or in combination with the flee radical scavenging antioxidant materials. Preferred chelants for use herein include citric acid, citrate salts (e.g., trisodium citrate), isopropyl citrate, Dequest® 2010 [available from Monsanto with a chemical name of 1-hydroxyethylidene-1,1-diphosphonic acid (etidronic acid)], TironR (available from Kodak with a chemical name of 4,5-dihydroxy-m-benzene-sulfonic acid/sodium salt), DTPAR (available from Aldrich with a chemical name of diethylenetriaminepentaacetic acid), ethylene diaminetetraacetic acid (EDTA), ethylene diamine-N,N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred are EDTA and especially citric acid and citrate salts.

Compositions according to the present invention preferably comprise a chelant in an amount of from about 10 ppm to about 0.5%, preferably from about 25 ppm to about 1000 ppm, by weight of the composition.

Optional Ingredients

Fully formulated fabric softening compositions preferably contain, in addition to the hereinbefore described components, one or more of the following ingredients:

Firstly, the presence of polymer having a partial or net cationic charge, can be useful to further increase the cellulase stability in the compositions herein. Such polymers can be used at levels of from 0.001% to 10%, preferably 0.01% to 2% by weight of the compositions.

Such polymers having a partial cationic charge can be polyamine N-oxide containing polymers which contain units having the following structure formula:

$$R—A_x—P$$

wherein P is a polymerisable unit, whereto the R—N→O group can be attached to or wherein the R—N→O group forms part of the polymerisable unit or a combination of both.

A is —NC(O)—, —C(O)O—, —C(O)—, —O—, —S—, —N—, x is 0 or 1;

R are aliphatic, ethoxylated aliphatics, aromatic, heterocyclic or alicyclic groups or any combination thereof whereto the nitrogen of the N→O group can be attached or wherein the nitrogen of the N→O group is part of these groups.

The N→O group can be represented by the following general structures:

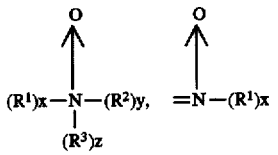

wherein $R^1$, $R^2$, and $R^3$ are aliphatic groups, aromatic, heterocyclic or alicyclic groups or combinations thereof, x or/and y or/and z is 0 or 1 and wherein the nitrogen of the N→O group can be attached or wherein the nitrogen of the N→O group forms part of these groups.

The N→O group can be part of the polymerisable unit (P) or can be attached to the polymeric backbone or a combination of both.

Suitable polyamine N-oxides wherein the N→O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N→O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N→O group is attached to the R-group.

Other suitable polyamine N-oxides are the polyamine oxides whereto the N→O group is attached to the polymerisable unit.

Preferred class of these polyamine N-oxides are the polyamine N-oxides having the general formula (A) wherein R is an aromatic, heterocyclic or alicyclic groups wherein the nitrogen of the N→O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (A) wherein R are aromatic, heterocyclic or alicyclic groups wherein the nitrogen of the N→O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers useful herein typically have a ratio of amine to the amine N-oxide of about 10:1 to about 1:1000000. However the amount of amine oxide groups present in the polyamine N-oxide containing polymer can be varied by appropriate copolymerization or by appropriate degree of N-oxidation. Preferably, the ratio of amine to amine N-oxide is from about 2:3 to about 1:1000000. More preferably from about 1:4 to about 1:1000000, most preferably from about 1:7 to about 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide coming polymer can be obtained in almost any degree of polymerisation. The degree of polymerisation is not critical provided the material has the desired water-solubility and dye-suspending power.

Typically, the average molecular weight of the polyamine N-oxide containing polymer is within the range of about 500 to about 1000,000; preferably from about 1,000 to about 50,000, more preferably from about 2,000 to about 30,000, most preferably from about 3,000 to about 20,000.

Such polymers having a net cationic charge include polyvinylpyrrolidone (PVP) as well as copolymers of N-vinylimidazole N-vinyl pyrrolidone, having an average molecular weight range in the range about 5,000 to about 100,000,preferably about 5,000 to about 50,000; said copolymers having a molar ratio of N-vinylimidazole to N-vinylpyrrolidone from about 1 to about 0.2, preferably from about 0.8 to about 0.3.

Surfactant/Concentration Aids

Although as stated before, relatively concentrated compositions of the unsaturated material of Formula (I) and (II) above can be prepared that are stable without the addition of concentration aids, the concentrated compositions of the present invention may require organic and/or inorganic concentration aids to go to even higher concentrations and/or to meet higher stability standards depending on the other ingredients.

Surfactant concentration aids are typically selected from the group consisting of single long chain alkyl cationic surfactants; nonionic surfactants; amine oxides; fatty acids; or mixtures thereof, typically used at a level of from 0 to about 15% of the composition.

Such mono-long-chain-alkyl cationic surfactants useful in the present invention are, preferably, quaternary ammonium salts of the general formula:

$$[R^2N^{+R3}]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from about 0.1% to about 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

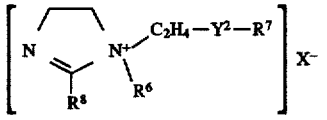

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

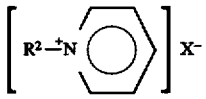

wherein $R^2$ and $X^-$ are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from 7 to 20, preferably from 8 to 15.

Examples of particularly suitable nonionic surfactants include Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from the group consisting of alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 10 to 14 (mid cut), carbon atoms. The shorter moiety contains from 1 to 4, preferably from 1 to 2 carbon atoms.

Electrolyte Concentration Aids

Inorganic viscosity control agents which can also act like or augment the effect of the surfactant concentration aids, include water-soluble, ionizable salts which can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 20,000 parts per million (ppm), preferably from about 20 to about 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

Liquid Carrier

Another optional, but preferred, ingredient is a liquid carrier. The liquid carrier employed in the instant compositions is preferably at least primarily water due to its low cost relative availability, safety, and environmental compatibility. The level of water in the liquid carrier is preferably at least about 50%, most preferably at least about 60%, by weight of the carrier. Mixtures of water and low molecular weight, e.g., < about 200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Still other optional ingredients are Soil Release Polymers, bacteriocides, colorants, perfumes, preservatives, optical brighteners, anti ionisation agents, antifoam agents, and the like.

EXAMPLES 1–3

The following concentrated compositions are prepared:

| Ingredients | Example 1 % by weight | Example 2 % by weight | Example 3 % by weight |
|---|---|---|---|
| N,N-di(2-tallowoxyl-oxy-ethyl)-N,N-dimethyl ammonium chloride IV = 18 | 23% | 23% | 23% |
| Tallowalcohol ethoxylated 25 times | 2% | 2% | 2% |
| Polyglycerolmonostearate | 3.5% | 3.5% | 3.5% |
| Cellulase* CEVU/g of composition | 8.50 | 67 | 67 |
| Hydrochloric acid | 0.08% | 0.08% | 0.08% |
| PVNO** | — | — | 0.5% |

-continued

| Ingredients | Example 1 % by weight | Example 2 % by weight | Example 3 % by weight |
|---|---|---|---|
| Polyethylene glycol MW: 4000 | 0.6% | 0.6% | 0.6% |
| Calcium chloride | 0.3% | 0.3% | 0.3% |
| Perfume | 0.9% | 0.9% | 0.9% |
| Irganox ®-3125*** | 106 ppm | 106 ppm | 106 ppm |
| EDTA | — | 145 ppm | 50 ppm |
| Tenox ® 6**** | — | — | 350 ppm |
| Dye, antifoam, water, minors | Balance to 100% | Balance to 100% | Balance to 100% |

pH (neat) = 2.3

*Most preferred cellulases are those as described in International Patent Application WO91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

**PVNO = poly(vinylpyridine N-oxide).

***Supplied by Ciba-Geigy.

****Supplied by Eastman Chemical Products, Inc., comprising 10% BHA, 10% BHT, 6% propyl gallate, 6% citric acid, 28% vegetable oil, 28% glyceryl monooleate, and 12% propylene glycol.

The formula of Example 1 is used in the typical European machine washing process to clean fabrics, especially cotton fabrics, by addition of 35 g of this composition to the rinse cycle of this process which uses 21 liters of water for the rinse solution (14 CEVU's of cellulase per liter of rinse solution) to provide cleaned fabrics having noticable fabric benefits.

The formulas of Examples 2 and 3 are used in the typical U.S. machine washing process to clean fabrics by addition of 30 g of this composition to the rinse cycle of this process which uses 64 liters of water for the rinse solution (31 CEVU's of cellulase per liter of rinse solution) to provide cleaned fabrics having noticable fabric benefits.

EXAMPLE 4

The following concentrated composition is also prepared:

| Ingredients | Example 4 (% by weight) |
|---|---|
| N,N-di(2-tallowoxyl-oxy-ethyl)-N,N-dimethyl ammonium chloride IV = 55 | 26% |
| Cellulase* | 0.735 |
| Hydrochloric acid | 0.01% |
| Perfume | 1.35% |
| Calcium chloride | 0.60% |
| Tenox ® 6 | 50 ppm |
| Irganox ® - 3125 | 106 ppm |
| Citric Acid | 30 ppm |
| EDTA | 76 ppm |
| Dye, antifoam, water and minors | balance to 100 |

*Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase; 5691 CEVU/g stock.

The formula of Example 4 is used in the typical U.S. machine washing process to dean fabrics by addition of 30 g of this composition to the rinse cycle of this process.

EXAMPLE 5

The following dilute composition is also prepared:

| Ingredients | Example 5 (% by weight) |
|---|---|
| N,N-di(2-tallowoxyl-oxy-ethyl)-N,N-dimethyl ammonium chloride IV = 18 | 5.5% |
| Tallowalcohol ethoxylated 25 times | 0.4% |
| Polyglycerolmonostearate | 0.8% |
| Cellulase* CEVU/g of composition | 3.5 |
| Hydrochloric acid | 0.04% |
| Perfume | 0.25% |
| Benzoic Acid | 0.3% |
| Tenox-6** | 500 ppm |
| Dye and water | balance to 100 |

pH (neat) = 2.3

*Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

**Supplied by Eastman Chemical Products, Inc.

The formula of Example 5 is used in the typical U.S. machine washing process to clean fabrics by addition of 100 g of this composition to the rinse cycle of this process which uses 64 liters of water for the rinse solution (5 CEVU's of cellulase per liter of rinse solution) to provide cleaned fabrics having noticable fabric benefits. The composition of Example 5 can also be formulated by substituting citric acid for the Tenox 6 at levels of 200 ppm or 2000 ppm.

EXAMPLE 6

The following concentrated composition is also prepared:

| Ingredients | Example 6 (% by weight) |
|---|---|
| Ditallow Dimethyl Ammonium Chloride | 10% |
| Varisoft 222* | 14.5% |
| Cellulase** CEVU/g of composition | 80 |
| Hydrochloric acid | trace |
| Perfume | 1.0% |
| Calcium chloride | 0.3% |
| Irganox-3125*** | 200 ppm |
| Dye, water and minors | balance to 100 |

pH (neat) = 5.6

*Methyl bis(tallowamidoethyl)(2-hydroxyethyl) ammonium methyl sulfate sold by Witco Chemical Company.

**Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

***Supplied by Ciba-Geigy.

The formula of Example 6 is used in the typical U.S. machine washing process to clean fabrics by addition of 30 g of this composition to the rinse cycle of this process which uses 64 liters of water for the rinse solution (37 CEVU's of cellulase per liter of rinse solution) to provide cleaned fabrics having noticable fabric benefits. The composition of Example 6 can also be formulated by substituting citric acid for the Irganox-3125 at levels of 200 ppm or 2000 ppm.

EXAMPLE 7

The following composition is also prepared:

| Ingredients | Example 7 (% by weight) |
|---|---|
| N,N-di(2-tallowoxyl-oxy-ethyl)-N,N-dimethyl ammonium chloride IV = 18 | 18% |
| Tallowalcohol ethoxylated 25 times | 1% |
| Polyglycerol monostearate | 2% |
| Cellulase* CEVU/g of composition | 5 |
| Hydrochloric acid | 75 ppm |
| Polyethyleneglycol MW: 4000 | 0.6% |
| Trisodium citrate | 0.2% |
| Perfume | 0.7% |
| Dye, antifoam water, minors | Balance to 100% |

pH (neat) = 4.1

*Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43 kD cellulase derived from *Humicola insolens*, DSM 1800, or which is homologous to said 43 kD endoglucanase.

The formula of Example 7 is used in the typical European machine washing process to clean fabrics by addition of this composition to the rinse cycle of this process.

What is claimed is:

1. A fabric conditioning composition comprising:

(a) from about 2% to about 50% of one or more cationic fabric softening agents, nonionic fabric softening agents, or mixtures thereof, (b) cellulase; and (c) from about 10 ppm to about 0.5% of free radical scavenging antioxidant materials.

2. The composition according to claim 1 wherein the cellulase consists essentially of a homogeneous endoglucanase component, which is immunoreactive with an antibody raised against a highly purified 43 kD cellulase derived from *Humicola insolens*, DSM 1800, or which is homologous to said 43 kD endoglucanase.

3. The fabric softening composition according to claim 1 comprising a quaternary ammonium softening agent, amine precursor softening agent, or mixtures thereof, and a cellulase, wherein the quaternary ammonium softening agent or amine precursor thereof is of the formula:

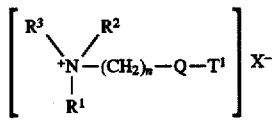

(I)

or

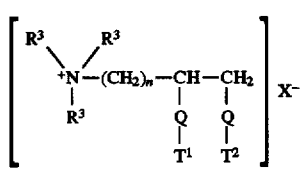

(II)

Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion.

4. The composition according to claim 3 wherein the quaternary ammonium softening agent is N,N-di(2-tallowoyl-oxy-ethyl)-N,N-dimethylammonium chloride.

5. The composition according to claim 1 wherein the free radical scavenging antioxidant material is selected from the group consisting of ascorbic acid, ascorbic palmitate, propyl gallate, butylated hydroxytoluene, butylated hydroxyanisole, tertiary butylhydroquinone, natural tocopherols, $C_8$–$C_{22}$ esters of gallic acid, tetrakis(methylene (3,5-di-tert-butyl-4-hydroxyhydrocinnamate))methane; thiodiethylene bis(3,5-di-tert-butyl-4-hydroxyhydrocinnamate); calcium bis(monoethyl(3,5-di-tert-butyl-4-hydroxybenzyl)phosphonate); 1,3,5-tris(3,5-di-tert-butyl-4-hydroxybenzyl)-s-triazine-2,4,6-(1H,3H,5H) trione; 3,5-di-tert-butyl-4-hydroxy-hydrocinnamic acid triester with 1,3,5-tris(2-hydroxyethyl)-S-triazine-2,4,6-(1H,3H,5H)-trione; N,N'-hexamethylene bis(3,5-di-tert-butyl-4-hydroxyhydro-cinnamamide); and mixtures thereof.

6. The composition according to claim 3 wherein the free radical scavenging antioxidant material is selected from the group consisting of ascorbic acid, ascorbic palmitate, propyl gallate, butylated hydroxytoluene, butylated hydroxyanisole, tertiary butylhydroquinone, natural tocopherols, $C_8$–$C_{22}$ esters of gallic acid, tetrakis(methylene (3,5-di-tert-butyl-4-hydroxyhydrocinnamate))methane; thiodiethylene bis (3,5-di-tert-butyl-4-hydroxyhydrocinnamate); calcium bis(monoethyl(3,5-di-tert-butyl-4-hydroxybenzyl)phosphonate); 1,3,5-tris(3,5-di-tert-butyl-4-hydroxybenzyl)-s-triazine-2,4,6-(1H,3H,5H) trione; 3,5-di-tert-butyl-4-hydroxy-hydrocinnamic acid triester with 1,3,5-tris(2-hydroxyethyl)-S-triazine-2,4,6-(1H,3H,5H)-trione; N,N'-hexamethylene bis(3,5-di-tert-butyl-4-hydroxyhydro-cinnamamide); and mixtures thereof.

7. The composition according to claim 6 wherein the free radical scavenging antioxidant material is selected from BHT, BHA, TBHQ, propyl gallate, 3,5-di-tert-butyl-4-hydroxy-hydrocinnamic acid triester with 1,3,5-tris(2-hydroxyethyl)-S-triazine-2,4,6-(1H,3H,5H)-trione, and mixtures thereof.

8. A process for machine treatment of fabrics during the rinse cycle of a machine washing process, said process comprising treating fabric during the rinse cycle of a machine washing process with a rinse solution containing the composition according to claim 1.

9. A process for machine treatment of fabrics during the rinse cycle of a machine washing process, said process comprising treating fabric during the rinse cycle of a machine washing process with a rinse solution containing the composition according to claim 2.

10. A fabric conditioning composition comprising:

(a) from about 1% to about 80% of fabric softening agents of the formula:

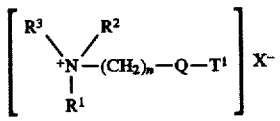

(I)

or

-continued

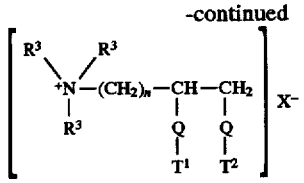

(II)

Q is —O—C(O)— or —C(O)—O— or —O—C(O)—O— or —$NR^4$—C(O)— or —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are (the same or different) $C_{11}$–$C_{22}$ alkyl or alkenyl;

n and m are integers from 1 to 4; and $X^-$ is a softener-compatible anion;

(b) from about 5 CEVU/gram to about 125 CEVU/gram, by weight of the composition, of a cellulase consisting essentially of a homogeneous endoglucanase component, which is immunoreactive with an antibody raised against a highly purified 43 kD cellulase derived from *Humicola insolens*, DSM 1800, or which is homologous to said 43 kD endoglucanase; and (c) from about 10 ppm to about 0.5% of a free radical scavenging antioxidant material selected from the group consisting of ascorbic acid, ascorbic palmitate, propyl gallate, butylated hydroxytoluene, butylated hydroxyanisole, tertiary butylhydroquinone, natural tocopherols, $C_8$–$C_{22}$ esters of gallic acid, tetrakis (methylene(3,5-di-tert-butyl-4-hydroxyhydrocinnamate))methane, thiodiethylene bis (3,5-di-tert-butyl-4-hydroxyhydrocinnamate), calcium bis(monoethyl(3,5-di-tert-butyl-4-hydroxybenzyl) phosphonate), 1,3,5-tris(3,5-di-tert-butyl-4-hydroxybenzyl)-s-triazine-2,4,6-(1H,3H,5H) trione, 3,5-di-tert-butyl-4-hydroxy-hydrocinnamic acid triester with 1,3,5-tris(2-hydroxyethyl)-S-triazine-2,4,6-(1H,3H,5H)-trione, N,N'-hexamethylene bis(3,5-di-tert-butyl-4-hydroxyhydro-cinnamamide), and mixtures thereof.

11. The composition according to claim 10 wherein the quaternary ammonium softening agent is N,N-di(2-tallowoyl-oxy-ethyl)-N,N-dimethylammonium chloride.

12. The composition according to claim 11 wherein the free radical scavenging antioxidant material is selected from BHT, BHA, TBHQ, propyl gallate, 3,5-di-tert-butyl-4-hydroxy-hydrocinnamic acid triester with 1,3,5-tris(2-hydroxyethyl)-S-triazine-2,4,6-(1H,3H,5H)-trione, and mixtures thereof.

13. A process for machine treatment of fabrics during the rinse cycle of a machine washing process, said process comprising treating fabric during the rinse cycle of a machine washing process with a rinse solution containing the composition according to claim 10.

14. A process for machine treatment of fabrics during the rinse cycle of a machine washing process, said process comprising treating fabric during the rinse cycle of a machine washing process with a rinse solution containing the composition according to claim 12.

* * * * *